5/8/84 OR 4,447,729

United States Patent [19]

Doroszlai et al.

[11] 4,447,729

[45] May 8, 1984

[54] TRANSPORT CONTAINERS FOR RADIOACTIVE MATERIAL

[75] Inventors: Pal Doroszlai, Kirchdorf; Ferruccio Ferroni, Zurich, both of Switzerland

[73] Assignee: Elektrowatt Ingenieurunternehmung AG., Switzerland

[21] Appl. No.: 253,751

[22] PCT Filed: Aug. 1, 1980

[86] PCT No.: PCT/CH80/00093

§ 371 Date: Apr. 20, 1981

§ 102(e) Date: Apr. 20, 1981

[87] PCT Pub. No.: WO81/00642

PCT Pub. Date: Mar. 5, 1981

[30] Foreign Application Priority Data

Aug. 20, 1979 [CH] Switzerland ..... 7593/79

[51] Int. Cl.[3] ..... G21F 5/00

[52] U.S. Cl. ..... 250/506.1; 250/507.1

[58] Field of Search ..... 250/506.1, 507.1; 376/272

[56] References Cited

U.S. PATENT DOCUMENTS 3,619,616 11/1971 Smith ..... 250/108
3,886,368 5/1975 Rollins et al. ..... 250/507
3,962,587 6/1976 Dufrane et al. ..... 250/506
4,268,755 5/1981 Weber et al. ..... 250/506.1
4,336,460 6/1982 Best et al. ..... 250/506.1

FOREIGN PATENT DOCUMENTS 2334177 7/1977 France .
1496846 6/1978 United Kingdom .

OTHER PUBLICATIONS

Cohen, Al, "Equipment News", Power, vol. 114, No. 2, Feb. 1970, p. 90.

*Primary Examiner*—Bruce C. Anderson
*Attorney, Agent, or Firm*—Lewis H. Eslinger

[57] ABSTRACT

A cylindrical container for the transportation of radioactive reactor elements includes a top end, a bottom end and a pair of removable outwardly curved shock absorbers, each including a double-shelled construction having an internal shell with a convex intrados configuration and an external shell with a convex extrados configuration, the shock absorbers being filled with a low density energy-absorbing material and mounted at the top end and the bottom end of the container, respectively, and each of the shock absorbers having a toroidal configuration, and deformable tubes disposed within the shock absorbers and extending in the axial direction of the container.

9 Claims, 10 Drawing Figures

TRANSPORT CONTAINERS FOR RADIOACTIVE MATERIAL

The invention involves a cylindrical container for the transportation of irradiated reactor elements.

Transport containers for radioactive materials must be designed so that the leakage of radioactive substances is safely avoided even in an extremely serious accident. Among such accidents in this sense are:

The free fall of the container (e.g., from a transporting vehicle) and the shock against a hard, unyielding surface Conflagrations submerging in water.

Cases capable of withstanding such accidents, consisting of massive, forged steel cylinders, tightly sealed top and bottom, are known. The heavy steel body stops gamma radiation. As a shield against neutron radiation, the container is provided with an outer water jacket.

Lateral cooling ribs serve both as heat radiators and as energy absorbers in the event of a lateral impact against the container. Shock absorbers may be mounted on the ends of the container to act as neutron shields as well as energy abosrbers.

In the known containers, a particular defect is the energy absorption against shock. Depending on the angle of the fall and the type of shock, there may be unequal inertial values with local points of very high inertia that may lead to damage to the container.

The purpose of the invention is to eliminate these defects and to furnish a transport container whose energy absorption characteristics will be essentially uniform in all directions when the shock occurs.

This problem is solved in such fashion that the removable shock absorbers mounted on top and on bottom of the container are in the form of a double shell. In an effective variation of the invention, the shock absorbers are torus-shaped and filled with balso wood in which the fibers of the wood are parallel to the direction of the container's axis.

Figure 1:
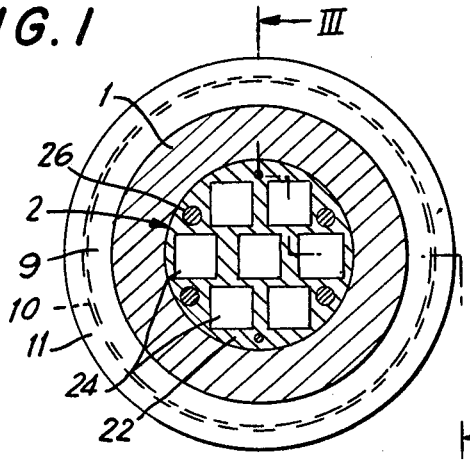
Figure 4:
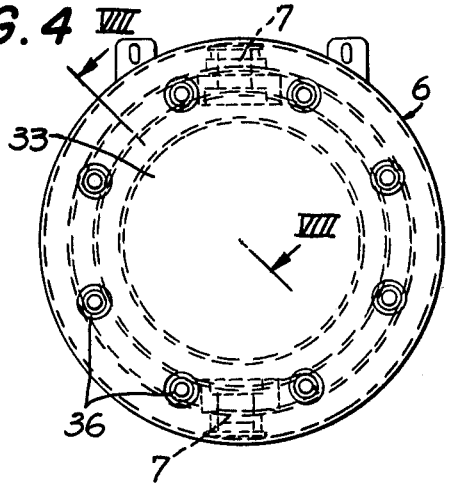
Figure 5:
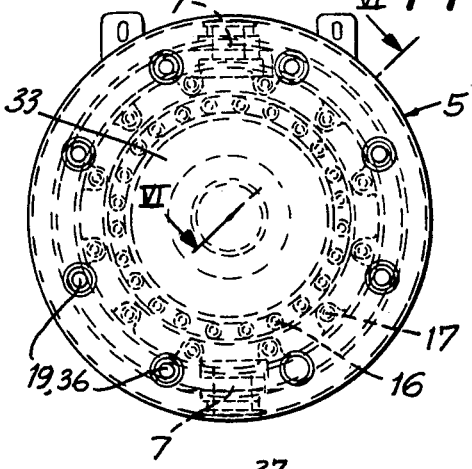
Figure 6:
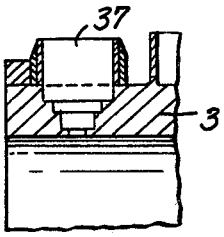
Figure 7:
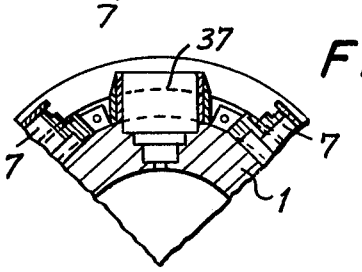
Figure 8:
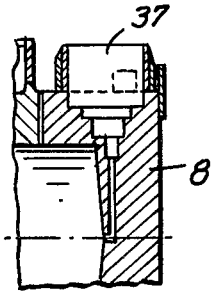
Figure 9:
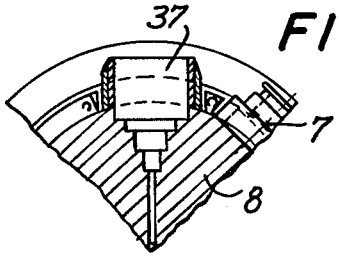
Figure 10:
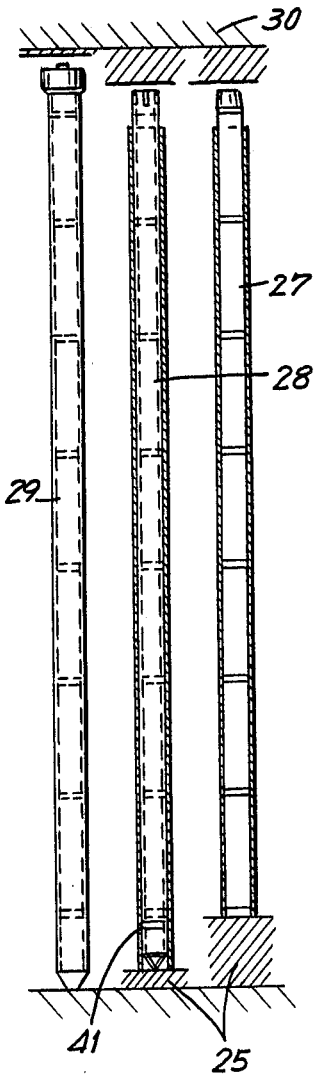

With the aid of the drawings, examples of the forms the invention may take are explained in greater detail in what follows. Shown are:

FIG. 1, a cross section through an empty transport container for seven irradiated reactor elements, FIG. 2, a cross section through another transport container for seventeen irradiated reactor elements, FIG. 3, a longitudinal section along the line III—III through the empty transport container of FIG. 1, FIG. 4, a view from below of the floor of the container and the screw-mounted shock absorbers of FIG. 3, FIG. 5, a plan view of the container cover with a mounted shock absorber of FIG. 3, FIG. 6, a section along the line VI—VI of FIG. 5, FIG. 7, a section along the line VII—VII of FIG. 3, FIG. 8, a section along the line VIII—VIII of FIG. 4, FIG. 9, a section along the line IX—IX of FIG. 3, and FIG. 10, various reactor elements to be transported in the container.

The transport container shown in the figures consists essentially of the cylindrical container body 1, the removable holder 2 for the reactor element, the inner cover plate 3, the outer container cover 4, and the two shock absorbers 5, 6 mounted on the ends of the container.

The inner space of the container is designed so that different holders 2, 21 with different capacities, for example, seven reactor rods (FIG. 1) or seventeen reactor rods (FIG. 2) can be stored in it. Six carrier pegs 7, four of them mounted on top and two on bottom, are provided for lifting the container.

The transport container has a massive steel cylinder 1 with a cylinder floor 8 welded to it. The inner cover plate 3 is fixed to the steel cylinder 1 by means of the bolts 16. The cylinder 1, the floor 8, and the inner cover plate 3 are forged from carbon steel, and provide good shielding against gamma radiation. The inner space of the container as well as the outer parts, which may become radioactively contaminated, are encased in sheet stainless steel.

The cylindrical part of the container is surrounded by a water jacket 9. The water jacket extends axially from the lower to the upper carrier pegs 7 for the purpose of isolating the active reactor element zone of all reactor element types involved. The water serves as a neutron shield to stop fast neutrons. The outer casing 10 of the water jacket is surrounded by rings of cooling ribs 11 made of iron, which are provided for heat dissipation and are welded to the outer casing 10.

At the upper end of the casing 10 is a ring-shaped expansion space 12, separated from the water. Two concentrically arranged bellows 13 made of stainless steel are placed in this gas-filled expansion space 12. With expansion of the water, the gas in the expansion space 12 is compressed between the bellows 13. The latter will then be equally squeezed together. The normal operating pressure of the water amounts to 2 bars, approximately. To defend the outer casing 10 against excessively high water pressures, several small safety discs are installed in it. To fill in or empty out the water, valves are located at opposite sides of the lower end of the casing 10. Another valve opens into the expansion space 12 for filling the space with gas or emptying it.

The casing 10 is sealed with thick, surrounding, lateral ribs 14 top and bottom. These lateral ribs 14 act to deaden shock.

Temperature sensors for controlling the temperature of the container are provided, which penetrate to different extents into the container. The temperature sensors are set in the warmest part of the container body 1, directly before the cooling ribs. For best operation, the temperature sensors are placed in a tube, indeed in such fashion as to offer no direct way for the diffused gamma rays to get out.

The overall length of the container body 1 is 5.29 m. The depth of the container, measured from the surface of the flange 15 to the container floor, is 5.12 m. With the inner covering plate 3 applied and no spacers used, the maximum depth is 4.675 m.

The iron cooling ribs 11 are protected by an epoxy resin layer that can be decontaminated of radioactive material. All other exposed parts of the container, with the exception of the heavy stainless steel ribs 14 at the ends of the ribbed region of the casing, are either made of stainless steel or are at least covered by a layer of 3-mm thick sheet stainless steel. This is true also of the inner hollow surface of the container. The cover is put on by welding.

For the sake of safety, the transport container is double-locked. The inner cover plate 3 with the ring flange 15 and the holding bolts 16, the outer container cover 4 with the holding bolts 17, three metal O-rings, not shown in detail, and the flange 18 with holes for the holding bolts 19 of the shock absorbers 5 and 6, serve to lock the container. Various spacer discs can be attached to the inner cover plate 3 to accommodate the size of the container inner space to transported reactor rods. The inner cover plate 3 and the spacer discs fixed to it by bolts form an integral transport unit. Since the inner cover plate 3 is forged from solid steel, sufficient shielding against gamma rays is guaranteed. Protection against neutron radiation is provided by both shock absorbers 5 and 6, which are filled with balsa wood 20.

The 24 equally spaced bolts 16 secure the inner covering plate 3 by means of the ring flange 15 to the container body 1. The upper container cover 4 is held by 12 additional, equally spaced bolts, 17. The ring flange 18 as well as eight other equally spaced bolts 19 serve to hold the shock absorbers 5 and 6. The bolts 16, 17, 19, the ring flanges 15 and 18, and the upper cover 4 are made of stainless steel. The inner cover plate 3 is itself encased in sheet stainless steel.

Figure 2:
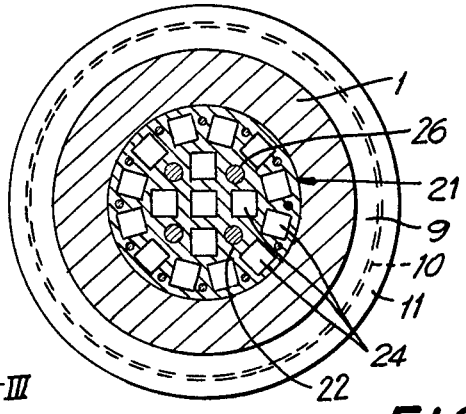
Figure 3:
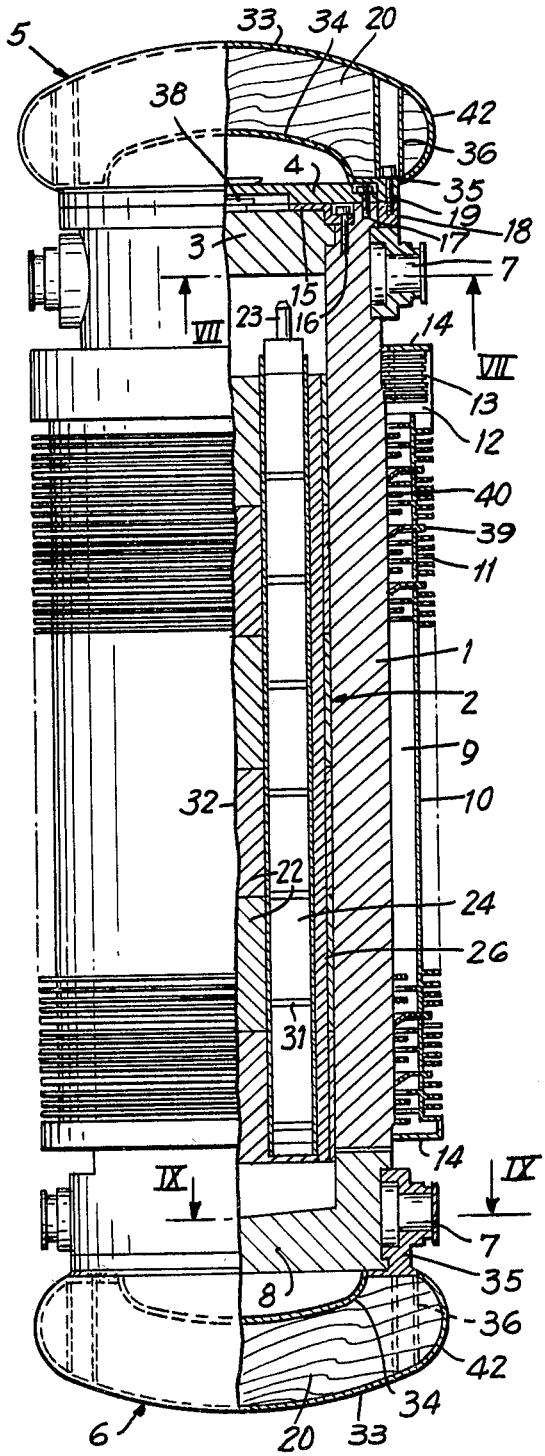

Two holders 2 and 21 are shown in FIGS. 1 and 2; these can be installed in the transport container. The holder 2 of FIG. 1 serves to hold seven reactor elements, while the holder 21 of FIG. 2 can hold 17 reactor elements. These holders 2 and 21 have high inner strength and guarantee neutron shielding for safe transportation of the reactor elements. Also, the holders are so constructed that they can withstand any accident situations imaginable.

Normally, reactor elements are transported in their dry state. The holders 2 and 21 provided for that, are made of thick, cast aluminum discs set one above the other, 22 held together by rust-free bolts 23. Between the inner wall of the container and the aluminum discs 23 there is a cylindrical gap to take care of thermal expansion. Elongated reactor channels 24 made of rust-free boron steel are set into the inside of the holders 2 and 21. A part of 1% by weight of neutral boron serves for absorption of the neutrons. The holders 2 and 21 also have lower spacing plates 25 (FIG. 10) for the reactor elements. Between the channels 24, cylindrical holes 26 are provided for the reactor elements containing a graphite/boron carbide maxture coated by rust-free steel tubes. This mixture is also a component of the neutron shield.

The reactor elements 27–29 can be transported with or without a protective coating 41. If the transportation is done without additional protective coating, supplemental stainless steel channels must be welded to the lower spacing plates 25 which penetrate into the channels 24 from below.

One or more of the outer boron steel channels 24 may be placed in the holder 2 in removable fashion. By taking out these channels 24, special protective containers for harmful reactor elements can be installed in the space left free. The upper, nonremovable channels 24 are welded to the upper stainless steel plate 30 of the holder 2. In that form, free thermal expansion below is unhindered.

For the wet transportation of reactor elements, thin-walled tubes made of boron steel are installed in the channels 24. To keep these thin-walled tubes from collapsing, spreader rings 31 are provided and set at a distance from one another. These spreader rings 31 have holes in them to permit the water to circulate freely. For transportation in the horizontal position, the weight of the reactor elements is sustained by the spreader rings 31.

So that the holder 2 or 21 may be installed in the transport containers in a straight line and be prevented from turning or shifting during transportation, a longitudinal groove is made in its outer surface into which a corresponding projection penetrates to the inner wall of the container.

The carrier pegs 7 serve, on the one hand, as handles for lifting in the transportation, and on the other for fastening the container to a transporting bed. A saddle device welded to a transport skid, for example, may serve as the transporting bed. The carrier pegs 7 are screwed into the container body 1 and are removable. With the exception of their inner section, they are deformable. The two lower carrier pegs 7 are eccentric with respect to the container axis 32. The purpose of this is to provide for the tilting of the transport container to a particular side with sagging of the container on the saddle device. The carrier pegs and the bolts are made of stainless steel.

The shock absorbers 5 and 6 consist essentially of a thick outer shell 33, a thin inner shell 34, a balsa wood filling 20, and a number of tubes 36. Both shells 33 and 34 are welded to the outside of a ring flange 35. The flange 35 serves as the centering of the shock absorber when it is put on. It is fixed to the container body 1 by means of the holding bolts 19. The thick-walled tubes 36 going through the shock absorber 5 are welded to the outer shell 33 and to the ring flange 35. The bolts 19 can be inserted through the tubes 36.

If the transport container should fall downward in the axial direction, the kinetic energy will be absorbed on impact by the following elements:

The outer shell 33, convex on the outside and circular in plan view, which is relatively soft and yielding in the axial direction, The filling 20 of balsa wood, whose fibers run parallel to the container axis 32. The balsa wood is capable of absorbing a substantial part of the kinetic energy, The hard tubes 36, which can along cancel out some 50% of the energy by deformation.

In a sidewise fall of the transport container, the kinetic energy will be taken up by the toroidal part 42 of the outer shell 33, on the one hand, and by the massive end ribs 14 on the other. Both are simultaneously deformed to some extent, and absorb about the same amount of energy. In sidewise fall, the absorption capacity of the balsa wood is negligible because of the aforementioned fiber orientation.

If the transport container tilts on one edge, a combination of the energy absorption of both the aforementioned cases occurs in which more or less energy is absorbed depending on the angle of fall.

The described construction of the transport container permits uniform inertia and energy absorption in all directions with no deficient inertial points such as those found in conventional containers with only deformable ribs. Also advantageous is the uniform distribution of the deformation on the outer surface of the present transport container. Inertial values of between 30 and 40 g can be expected, depending on the direction of fall.

It can furthermore be established that the transport container is only slightly sensitive to brittle cracking at low temperatures.

The carrier pegs 7 are also deformable and can also absorb kinetic energy if they make head-on impact in a sidewise fall. The outer shells 33 and all tubes 36 are made of stainless steel. The sealed inner space between the inner and outer shells is hermetically locked; consequently the balsa wood filling cannot become damp.

As has already been mentioned, the container is positioned horizontally on a saddle device with skids in transportation. The carrier pegs are then supported by the saddle device. For rail transportation, the container is loaded on a flatcar or a special bridge car. In the first case, the whole arrangement, consisting of skid, container, and cover, has the dimensions of a standard container and can therefore be immediately loaded on a vessel and transported further. In the second transportation method with the bridge car, the center of gravity is lower so that higher speeds can be attained in transportation.

The hollow space inside the container is accessible through the inner cover plate 3, held down by the ring flange 15, by the two valves 37, and by small, sealable openings in the cover plate 3 for taking samples. The sealing of the inner hollow space is guaranteed by both the valves 37 as well as the metal O-rings between the ring flange 18 and the inner locking cover 3 or between this flange 18 and the corresponding sealing surface of the container body 1. An opening for the removal of samples in controlling the inner space atmosphere is in the carrier peg 38 of the inner sealing cover 3.

The outer container space is sealed principally by the outer container cover 4 and the valve cover. Between the outer container cover 4 and the container body are plastic O-rings while the valve covers are sealed to the valves by metal O-rings. In the outer cover 4 as in the valve covers are openings for sample removal and for control. These are used specially to test the sealing of the inner space. A particular advantage of the dual inner space is that the valve between both inner spaces keeps a constant check on the escape of radioactive material.

All removable parts in the container inner space, with the exception of the cast aluminum discs in the holder, are made of stainless steel or sheathed with sheet stainless steel of at least 3-mm B thickness. The stainless steel is resistant to the following cleaning and decontaminating fluids:

Distilled water,
Nitric acid,
Caustic soda, and
Nitrofluorine solution with 5% fluorine.

The lower part of the container inner space may be cleaned by way of the lower valves.

All of the outer container surfaces, including the fluid pump, are also coated with sheet stainless steel, with the exception of the area containing the cooling ribs. In wet unloading of the transport container, when it is immersed in a discharge pool, the cooling-rib area of the container is covered with a special shield. This last consists of a cylindrical coat of stainless steel with inflatable rubber packing. Before the transport container is immersed in the discharge pool, however, it is set up vertically and fixed to a base plate by means of the lower carrier pegs 7. The stainless steel coat is then applied and is filled by the inflatable rubber packing. At the lower end of the coat opposite the container valve is a removable cover by which conduit pipes can be connected to the container valve even after the coat has already been applied. During this operation, the valve between the upper and lower packing can be emptied while the cooling-rib area is still surrounded by water.

With the transport container immersed, the water pressure between the two inflatable packings at both ends is higher than it is outside, so that no water from the unloading pool can get into the rib area. The ribs are applied with epoxy resin paint, which can be easily cleaned and rendered harmless if contaminated by radioactivity.

As soon as the coat is applied, the accumulated heat must be dissipated by cooling of the rib area. For that reason connection to cooling water is required for the coating procedure.

Heat is dissipated from the container by convection and heat radiation, principally by the cooling ribs since both shock absorbers are heat insulators. Small amounts of heat are also dissipated through the carrier pegs and the unribbed coat surface.

For a shock to the container as the result of a free fall or a fire, a loss of water in the coating 10 is taken into account. The empty coating 10 then acts as an insulating layer, and even the cooling ribs 40 inside still dissipate the heat.

The various accident possibilities can be investigated by computer simulation. These possibilities will not be discussed further here.

We claim:

1. A cylindrical container for the transportation of radioactive reactor elements, said container including a top end, a bottom end and a pair of removable outwardly curved shock absorbers each including a double-shelled construction having an internal shell and an external shell with a convex extrados configuration, said shock absorbers being filled with low density energy-absorbing material and mounted at said top end and said bottom end of the container, respectively, and each of said shock absorbers having a toroidal configuration, and deformable tubes disposed therein and extending in the axial direction of said container.

2. A container as claimed in claim 1, wherein said external shell is thicker than said internal shell.

3. A container as claimed in claim 2, wherein the container has a body, the internal and external shells are made from rustproof steel, said shells having rims which are welded to an annular flange which is secured to the container body.

4. A container as claimed in claim 3, wherein said deformable tubes have a thick-wall configuration and are welded to the external shell and to the annular flange.

5. A container as claimed in claim 1, wherein said container includes an outer casing which encloses a cylinderical annular chamber, said annular chamber including a water-filled chamber and a gas-filled expansion chamber positioned in spaced relation thereto, said gas-filled expansion chamber having a concentrically disposed metal bellows positioned therein.

6. A container as claimed in claim 5, wherein the ends of the annular chamber are closed by side ribs, said side ribs being deformable for absorbing kinetic energy.

7. A container as claimed in claim 1, wherein said container includes partially deformable lifting lugs which are disposed at said bottom and said top ends of the container for absorbing energy.

8. A container as claimed in claim 1, wherein said toroidal configuration has an axis, and said deformable tubes are arranged in a circle in said container about an axis concentric with the axis of said toroidal configuration.

9. A container as claimed in claim 1 wherein said internal shell has a convex intrados configuration.

* * * * *